United States Patent [19]

Wassenhoven

[11] Patent Number: 4,543,779

[45] Date of Patent: Oct. 1, 1985

[54] SPINNING DEVICE

[75] Inventor: Heinz-Georg Wassenhoven, Monchen-Gladbach, Fed. Rep. of Germany

[73] Assignee: W. Schlafhorst & Co., Monchen-Gladback, Fed. Rep. of Germany

[21] Appl. No.: 633,412

[22] Filed: Jul. 23, 1984

[30] Foreign Application Priority Data

Jul. 23, 1983 [DE] Fed. Rep. of Germany ..... 3326671

[51] Int. Cl.[4] ..... D01H 7/898

[52] U.S. Cl. ..... 57/401

[58] Field of Search ..... 57/90, 400, 401, 408, 57/409, 411

[56] References Cited

U.S. PATENT DOCUMENTS

| | | | |
|---|---|---|---|
| 4,070,811 | 1/1978 | Fehrer | 57/401 |
| 4,399,650 | 8/1983 | Parker et al. | 57/401 |
| 4,404,792 | 9/1983 | Parker et al. | 57/401 |
| 4,420,928 | 12/1983 | Fehrer | 57/401 |
| 4,441,310 | 4/1984 | Parker et al. | 57/401 |

*Primary Examiner*—Donald Watkins

*Attorney, Agent, or Firm*—Herbert L. Lerner; Laurence A. Greenberg

[57] ABSTRACT

A spinning device for producing a twisted thread formed at least partially of spinning fibers, includes a flow generator having an air inlet and an air outlet, at least one rotating perforated drum having a given axis, a suction device disposed in the drum, the suction device having at least one suction opening disposed substantially parallel to the given axis and connected to the air inlet of the flow generator, another drum disposed outside the first-mentioned drum opposite the suction opening for forming a spinning wedge from flying fibers, a fiber loosening device for loosening fibers and conducting an air transport current, a fiber conduction channel for conducting the flying fibers and the air transport current from the fiber loosening device to the spinning wedge, means communicating with the fiber conduction channel for increasing the air transport current flowing through the fiber conduction channel, and an air conduction line connected from the air outlet of the flow generator to the air current increasing means.

8 Claims, 1 Drawing Figure

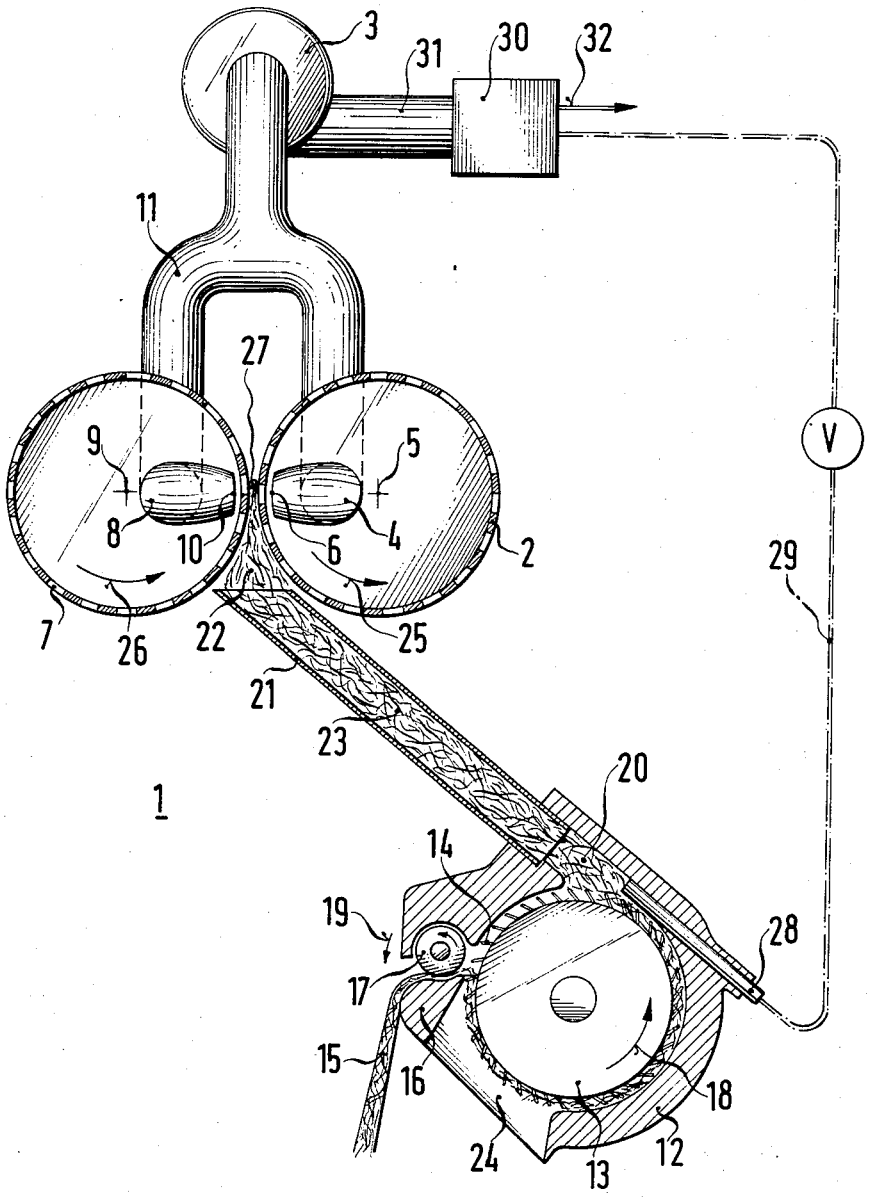
3
31
30
32
11
27
9
5
8
10
6
4
2
V
29
7
26
22
25
21
23
20
1
14
19
28
17
15
16
18
24
13
12

SPINNING DEVICE

The invention relates to a spinning device for producing a twisted thread formed at least partially of spinning fibers, including at least one rotating perforated drum having a suction device disposed therein with at least one suction opening disposed substantially parallel to the drum axis and connected to a flow generator, a similarly constructed device for forming a spinning wedge disposed outside the drum opposite the suction opening, the spinning fibers being flyingly introduced into the spinning wedge, a fiber loosening device through which an air transport current flows, a fiber conduction channel disposed between the fiber loosening device and the spinning wedge, through which fibers and transport air are conducted, and a device for increasing the air transport flow through the fiber conduction channel.

Spinning devices of this type require increased expenditures by requiring additional flow generators for the additional transport air. An additional flow generator also results in an additional burden on and pollution of, the environment, and furthermore requires additional energy consumption. The increased burden with respect to the environment is caused mainly by the noise generated by the added flow generator, and by the fact that due to the metering of the air, excessive air is discharged and is blown off, either near the flow generator itself, or even worse, in vicinity of the spinning wedge, thereby polluting the environment.

It is accordingly an object of the invention to provide a spinning device which overcomes the hereinaforementioned disadvantages of the heretofore-known devices of this general type, which reduces the burden on the environment, and which saves energy during the operation of the spinning device.

With the foregoing and other objects in view there is provided, in accordance with the invention, a spinning device for producing a twisted thread formed at least partially of spinning fibers, comprising a flow generator having an air inlet and an air outlet, at least one rotating perforated drum having a given axis, a suction device disposed in the drum, the suction device having at least one suction opening disposed substantially parallel to the given axis and connected to the air inlet of the flow generator, another drum or means disposed outside the drum opposite the suction opening for forming a spinning wedge from flying fibers, a fiber loosening device for loosening fibers and conducting an air transport current, a fiber conduction channel for conducting the flying fibers and the air transport current from the fiber loosening device to the spinning wedge, means communicating with the fiber conduction channel for increasing the air transport current flowing through the fiber conduction channel, and an air conduction line connected from the air outlet of the flow generator to the air current increasing means. In this way, a self-enclosed air circulation circuit is created, wherein the additional air depends on the respective output of the flow generating device, in an advantageous way. This creates a balanced relationship between the amount of air used by one or more suction devices, and the additional air introduced into the discharge region of the fiber loosening device, or into the fiber conduction channel. The air circulating in this circuit can be loaded with flying fibers or short fibers. Generally, this has no detrimental influence on the result of the spinning operation, because after a very short time a balanced dust, flying-fiber and short-fiber content of the recirculated air is already established.

In accordance with another feature of the invention, there is provided a filter connected in the air conduction line. This is done in case the feedback of dust, flying fibers and short fibers is not desired. In this case, the undesired particles are caught in the filter and can be removed from time to time, or can be reused in some other way.

In accordance with a further feature of the invention, the air current increasing means is in the form of a tube disposed in the fiber loosening device.

In accordance with a concomitant feature of the invention, the tube is axially movable in the fiber loosening device closer to and farther away from the fiber conduction channel.

Other features which are considered as characteristic for the invention are set forth in the appended claims.

Although the invention is illustrated and described herein as embodied in a spinning device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the single FIGURE of the drawing, which is a diagrammatic, partly elevational and partly cross-sectional view of a spinning device according to the invention.

Referring now to the FIGURE of the drawing in detail, there is seen a spinning device, which is designated with reference numeral 1 as a whole. The spinning device 1 includes a first rotating perforated drum 2. A suction device 4 that is connected to a flow generator 3, is disposed in the interior of the drum Z. The suction device 4 has a suction opening 6 directed against the inner wall of drum 2, and disposed parallel to the axis 5 of the drum, which is indicated by a cross.

A wedge forming device 7 which corresponds to the drum 2, is formed of a similarly perforated rotating drum which also has a suction device 8 in the interior thereof that is connected to the flow generator 3. The suction device 8 also has a suction opening 10 directed against the inner wall of the wedge former or drum 7, and disposed parallel to the drum axis 9, indicated by a cross. Both suction devices 4 and 8 are attached to the suction opening of the flow generator 3 by means of a branched pipe line 11.

Part of the spinning device 1 is a fiber loosening device 12 with a rotating loosening, disscolving or separating roller 13. The loosening roller 13 is equipped with a set of needles 14. A sliver 15 is conducted toward the loosening roller 13 over a guide table 16 with the aid of a rotating feed roller 17. The loosening roller 13 rotates in the direction of the curved arrow 18, and the feed roller 17 rotates in the direction of the curved arrow 19. The loosening roller 13 has a considerably greater peripheral speed than the guide roller 17, so that individual fibers are combed out from the sliver 15, and transported in direction toward a discharge channel 20, which is followed by a fiber conduction channel 21. The fiber conduction channel 21 terminates at a spinning wedge 22 which is formed by the drum 2 and the wedge forming device or drum 7. Separated spinning fibers 23 are carried along by an air transport current which enters at an inlet opening 24 formed in the housing of the fiber loosening device 12, passes through the fiber conducting channel 21, arrives at the spinning wedge 22, enters the pipe line 11 through the suction openings 6 and 10, and finally reaches the flow generator 3.

During the spinning operation, the rotational direction of the drum 2, which is indicated by arrow 25, is directed against the direction of the flying spinning fibers 23 of the sliver 15. The rotational direction of the drum 7 indicated by an arrow 26 is in the same sense as the rotational direction of drum 2, so that in the spinning wedge 22, the surface of the drum 7 moves in the direction of the flying spinning fibers 23. A thread 27 is formed approximately at the most narrow portion of the spinning wedge 22. The thread 27 is withdrawn from the spinning device 1 parallel to the drum axes 5 and 9, by non-illustrated means.

A device 28 is disposed at the point where the discharge channel 20 begins, for augmenting the air transport current which flows through the fiber conduction channel. The device 28 is formed of a tube disposed in the housing of the fiber loosening device 12 in such a way that it can slide longitudinally, so that the end of the tube can be adjusted according to the existing operating conditions.

The device 28 is connected to an outlet opening 31 of the flow generator 3 by an air line 29 and a filter 30. The pipe line 29 conducts only a part of the air flowing through the filter 30. An arrow 32 indicates that other air devices requiring air are connected to the filter 30. The amount of recirculated air can be regulated by a valve V which is inserted in pipe line 29.

The structure and adjustment capability of the device 28 contributes to the achievement of the objective of the invention, because only a well-controlled air supply device makes the increase of the air transport current in the fiber conduction channel practical. The important objective is always a good spinning performance with a small energy consumption, and minimum environmental burden.

The invention is not limited to the illustrated and described specific embodiment which was used as an example.

The foregoing is a description corresponding in substance to German application No. P 33 26 671.9, filed July 23, 1983, the International priority of which is being claimed for the instant application, and which is hereby made part of this application. Any material discrepancies between the foregoing specification and the aforementioned corresponding German application are to be resolved in favor of the latter.

I claim:

1. Spinning device for producing a twisted thread formed at least partially of spinning fibers, comprising a flow generator having an air inlet and an air outlet, at least one rotating perforated drum having a given axis, a suction device disposed in said drum, said suction device having at least one suction opening disposed substantially parallel to said given axis and connected to said air inlet of said flow generator, another drum disposed outside said first-mentioned drum opposite said suction opening for forming a spinning wedge from flying fibers, a fiber loosening device for loosening fibers and conducting an air transport current, a fiber conduction channel for conducting the flying fibers and the air transport current from said fiber loosening device to said spinning wedge, means communicating with said fiber conduction channel for increasing the air transport current flowing through said fiber conduction channel, and an air conduction line connected from said air outlet of said flow generator to said air current increasing means.

2. Spinning device for producing a twisted thread formed at least partially of spinning fibers, comprising a flow generator having an air inlet and an air outlet, at least one rotating perforated drum having a given axis, a suction device disposed in said drum, said suction device having at least one suction opening disposed substantially parallel to said given axis and connected to said air inlet of said flow generator, means disposed outside said drum opposite said suction opening for forming a spinning wedge from flying fibers, a fiber loosening device for loosening fibers and conducting an air transport current, a fiber conduction channel for conducting the flying fibers and the air transport current from said fiber loosening device to said spinning wedge, means communicating with said fiber conduction channel for increasing the air transport current flowing through said fiber conduction channel, and an air conduction line connected from said air outlet of said flow generator to said air current increasing means.

3. Spinning device according to claim 1, including a filter connected in said air conduction line.

4. Spinning device according to claim 2, including a filter connected in said air conduction line.

5. Spinning device according to claim 1, wherein said air current increasing means is in the form of a tube disposed in said fiber loosening device.

6. Spinning device according to claim 2, wherein said air current increasing means is in the form of a tube disposed in said fiber loosening device.

7. Spinning device according to claim 5, wherein said tube is axially movable in said fiber loosening device closer to and farther away from said fiber conduction channel.

8. Spinning device according to claim 6, wherein said tube is axially movable in said fiber loosening device closer to and farther away from said fiber conduction channel.

* * * * *